United States Patent [19]

Bassler et al.

[11] Patent Number: 4,571,012

[45] Date of Patent: Feb. 18, 1986

[54] SHIELDED ELECTRICAL CONNECTOR ASSEMBLY

[75] Inventors: Max Bassler, Austin, Tex.; Philip J. Dambach, Naperville, Ill.

[73] Assignee: Molex Incorporated, Lisle, Ill.

[21] Appl. No.: 685,200

[22] Filed: Dec. 21, 1984

[51] Int. Cl.[4] ..... H01R 4/66; H01R 13/46

[52] U.S. Cl. ..... 339/14 R; 339/143 R

[58] Field of Search ..... 339/14 R, 143 R, 143 C, 339/143 S, 143 T, 14 L, 14 P, 14 RP, 14 T

[56] References Cited

U.S. PATENT DOCUMENTS

| | | | |
|---|---|---|---|
| 3,366,918 | 1/1968 | Johnson et al. | 339/143 R |
| 3,922,056 | 11/1975 | Murawski et al. | 339/143 R |
| 4,381,129 | 4/1983 | Krenz | 339/143 R |
| 4,386,814 | 6/1983 | Asick | 339/143 R |
| 4,457,575 | 7/1984 | Davis et al. | 339/143 R |
| 4,516,815 | 5/1985 | Venable et al. | 339/143 R |

*Primary Examiner*—Gil Weidenfeld

*Assistant Examiner*—Gary F. Paumen

*Attorney, Agent, or Firm*—Louis A. Hecht

[57] ABSTRACT

Disclosed is a grounded receptacle assembly for mounting to a panel having a grounded conductive surface. The receptacle assembly includes a housing having a mounting face and a discontinuous array of spaced-apart clip members disposed about the mounting face, so as to be slidingly received in a wall of the receptacle housing. Each clip member includes a first end with a resilient tongue disposed within the housing cavity and has a second end with outwardly extending contact fingers that engage the conductive panel surface when the recptacle housing is mounted thereto. The mounting face is aligned with a plug receiving opening formed in the panel, so that a shielded plug connector can be received within the receptacle housing. When inserted within the receptacle assembly, the plug shield, which is located on an exterior surface of the plug body engages the resilient tongue so as to be electrically coupled to the grounded panel surface.

5 Claims, 4 Drawing Figures

SHIELDED ELECTRICAL CONNECTOR ASSEMBLY

BACKGROUND OF THE INVENTION

1. Field of the Invention

This invention pertains to shielded plug and receptacle connector assemblies, and in particular to shielded receptacle assemblies which are mounted in an aperture of a conductive panel.

2. Brief Description of the Prior Art

Many electronic circuits which are used to transmit signals are enclosed in metallic shielding for protection against the effects of electromagnetic radiation, electromagnetic interference (EMI), and the special category of radio frequency interference (RFI). There is an increasing need for separable electrical connectors which preserve the shielding properties of these circuits so as to not disturb the transmitted signal. In order to provide effective shielding, a connector system must provide a means for coupling the shields to a neutral ground potential and directing the interfering signals to ground.

Frequently, separable electrical connection is required at a housing wall, such as an electrically conductive wall of an electrical chassis. The possibility therefore arises to conveniently connect a connector shield to a conductive chassis wall which is grouned.

One such arrangement is provided in U.S. Pat. No. 3,922,056 issued to Murawski et al., on Nov. 25, 1975. In this arrangement, a receptacle member, mounted in the chassis wall, is completely surrounded by a metallic shield. The metallic shield is electrically connected to the chassis wall by a pair of generally L-shaped spring finger members, wherein one leg of the "L" is secured to the wall, and the other leg of the "L" wipes against the receptacle shield as it is inserted through the wall.

In U.S. Pat. No. 3,366,918 issued to F. W. Johnson, et al., on Jan. 30, 1968, a folded metal gasket provides a shell-to-shell-to-shelf RFI shield spring which is attached to a plug member mounted in the aperture of a conductive panel. The spring includes a number of outwardly directed fingers which are compressed by a metallic female socket, so that socket engages the plug member.

In yet another patent, U.S. Pat. No. 4,386,814 issued June 7, 1983 to John Asick, a kit is provided for converting an aperture of a conductive panel, into a shielded pin receptacle. The kit includes a unitary ground plane spring having a first set of fingers which engage the conductive panel, and a second set of fingers which project into the interior opening of a dielectric housing. The ground plane spring is trapped between the panel and the housing when the two are joined together. The second set of fingers wipe across the outside surface of a shielded plug-like connector which is inserted through the conductive panel and ground plane spring, being received within the dielectric housing. The latter arrangement, although providing a ready adaptation of existing equipment, requires a certain amount of time for a skilled operator to complete the kit conversion process. Also, a reliable grounding connection to the panel should be maintained, even if the panel or the housing should become warped. An integral, continuous ground plane spring may not provide the shape conformance required. Further, the conversion kit of U.S. Pat. No. 4,386,814 does not lend itself to automated assembly line fabrication procedures.

SUMMARY OF THE INVENTION

It is, therefore, an object of the present invention to provide an interference shield system which electrically couples the shield of a plug and receptacle assembly to a grounded conductive panel.

Another object of the present invention is to provide a fully fabricated receptacle assembly which is ready for mounting to a conductive panel to provide a grounding connection for a shielded plugs inserted within the receptacle.

Yet another object of the present invention is to provide a receptacle assembly having grounding clips which provide electrical connection between a grounded conductive panel and a shielded plug, wherein the assembly is comprised of a minimum number of inexpensive parts and can be readily assembled using automated mass production techniques.

A further object of the present invention is to provide a receptacle assembly having a discontinuous array of grounding clips which readily conform to a warped, or otherwise irregular surface. A related object of the present invention is to provide a plurality of independent grounding clips disposed about the mounting surface of a receptacle housing.

Yet another object of the present invention is to provide grounding clips for mounting in a dielectric housing, which are readily adapted to selective plating techniques, and are otherwise inexpensively formed using automated manufacturing methods.

These and other objects of the present invention are provided in a grounded receptacle assembly mountable in an opening of a panel having a grounded conductive surface for receiving and electrically engaging a shielded plug connector. The plug connector includes a housing, a plurality of terminals mounted in said housing and a conductive shield externally mounted on said plug housing. The receptacle assembly includes a receptacle housing with an open plug receiving end surrounded by a mounting face, a plurality of terminals mounted in said housing adapted to mate with said plug terminals and grounding means attached to said receptacle housing to connect the plug shield with the grounded panel. The improvement comprises:

said receptacle grounding means including a plurality of spaced-apart stamped metallic clips mounted in the receptacle housing, each clip having a mounting portion secured in the housing, a plug engaging end in the housing adapted to contact the plug shield and a spring portion extending out of the plug receiving opening adjacent the mounting face for resilient compression against the panel surface; and said receptacle housing including a plurality of slots formed in the mounting face and extending into the housing to receive the mounting portion of each clip therein.

The invention also includes a plug and receptacle connector assembly including the receptacle described above, in combination with a plug member having an external conductive shielding surface located adjacent its mating end.

DESCRIPTION OF THE DRAWINGS

In the drawings, wherein like elements are referenced alike.

DETAILED DESCRIPTION OF THE PREFERRED EMBODIMENT

Figure 1:
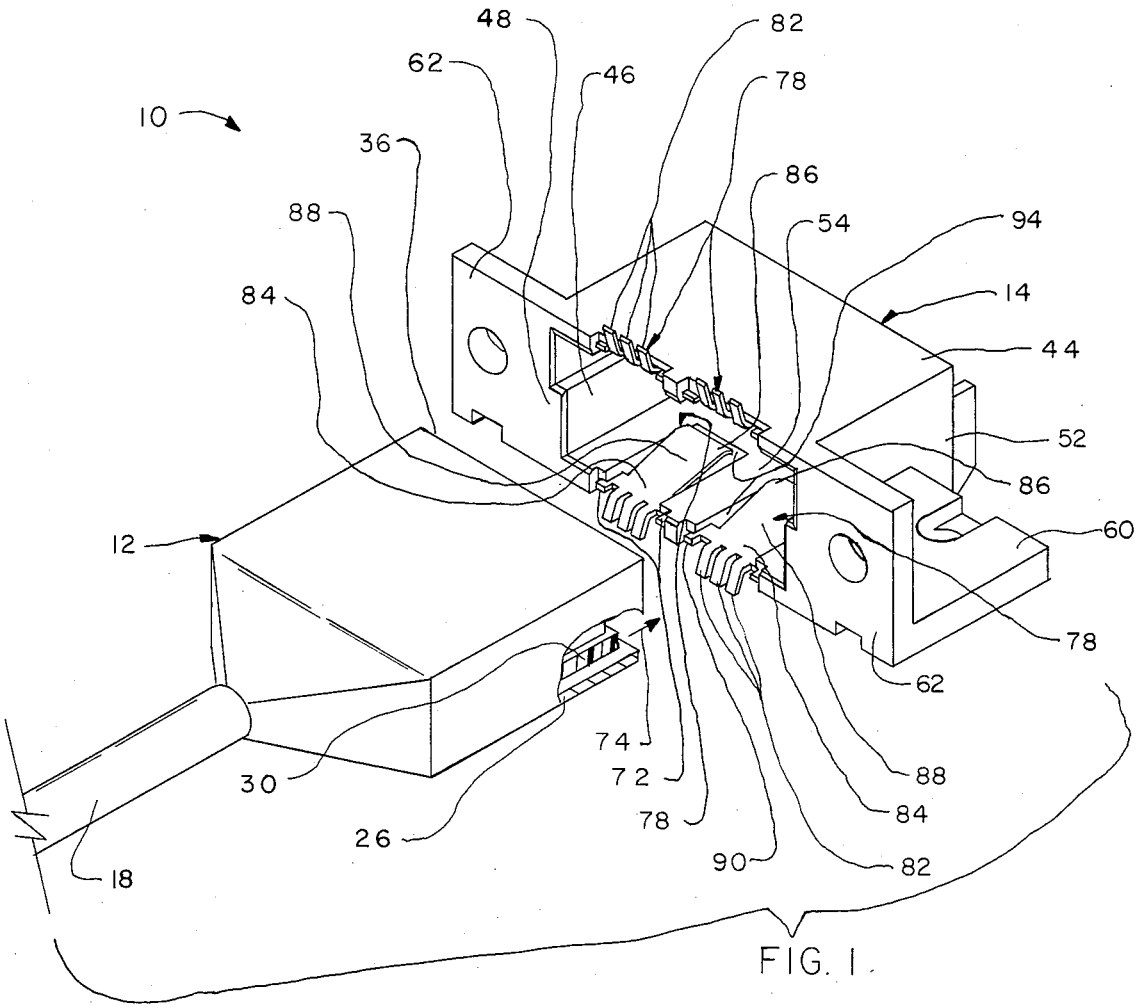
FIG. 1 is a perspective view of a plug and receptacle connector assembly according to the present invention.

Referring to FIG. 1, there is shown a plug and receptacle connector system 10 comprising a conventional plug 12 and a novel receptacle assembly 14. Connector system 10 connects a shielded cable 18 to another circuit element such as a printed circuit board, not shown in the drawings.

Figure 2:
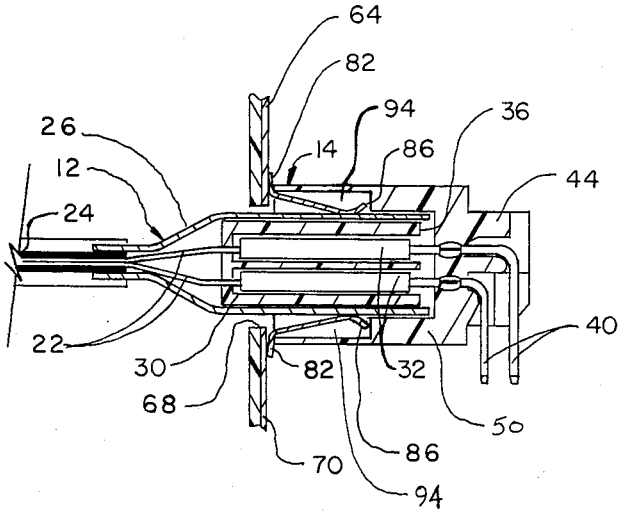
FIG. 2 is an elevational cross sectional view of the receptacle according to the present invention.

Referring now to FIG. 2, cable 18 is of a conventional shielded type, having a plurality of signal conductors 22 surrounded by a conductive cable shielding means 24. Cable shield 24 is electrically coupled to an external plug shield 26 affixed to the outer surface of plug 12. Plug shield 26 can comprise, for example, an outer metallic shell which is adapted to slip over a conventional dielectric plug housing 30.

Signal conductors 22 are connected to plug terminals 32 to form a conventional plug arrangement which is adapted for mating with the receptacle assembly. As indicated, plug 12 has a leading end 36 which is inserted with in receptacle assembly 14, so as to establish an electrical connection with a receptacle terminals 40.

Figure 3:
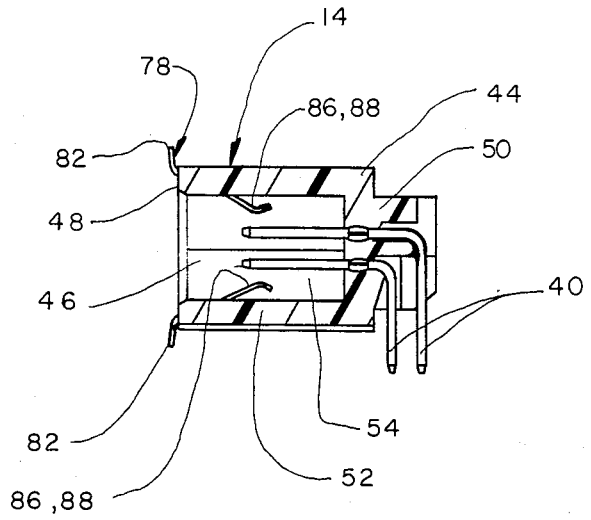
FIG. 3 is an elevational cross sectional view of the plug and receptacle of FIG. 1, shown in a mated position.

With reference to FIGS. 1–3, receptacle assembly 14 is seen to generally include a dielectric housing 44 having a first plug receiving end 46 with a mounting face 48, and a second opposed end 50 in which an array of terminals 40 is mounted in a conventional manner. The receptable housing 44 includes wall portions 52 extending between its first and second ends, to form an internal plug receiving cavity 54. The housing 44 of FIG. 1 includes a first set of mounting ears 60, for securement to the edge of a printed circuit, a chassis wall or the like horizontal mounting surface. Housing 44 also includes a second set of mounting ears 62 for mounting to a vertical panel 64 as indicated in FIG. 2. As shown in FIG. 2, the plug receiving end 46 is aligned with a plug receiving aperture 68 formed in panel 64.

To provide effective shielding of signal conductors 22, plug terminals 32, and receptacle terminals 40, a system for coupling external plug shield 26 to a ground potential must be provided. According to the present invention, receptacle assembly 14 includes an arrangement for grounding external plug shield 26 to a conductive surface 70 of panel 64.

As shown in FIG. 1, receptacle wall portions 52 include a plurality of opposed pairs of slots or channels 72 formed in receptacle wall 52, adjacent the plug receiving end 46 thereof. Channels 72 extend from the first plug receiving end 46 toward second closed end 50, extending in a direction parallel to the direction of insertion of plug member 12, as indicated by arrow 74 in FIG. 1.

A discontinuous array of conductive grounding clips 78 is disposed about the mounting face 48, with one clip being received in each opposed pair of channels 72. Clips 78 comprise spring contact members stamped from a blank of spring metal material and include a first end having resiliently compressible contact fingers 82 which are pressed against conductive panel surface 70 as receptacle assembly 14 is mounted to panel 64.

Each spring grounding clip 78 further include a medial body portion 84 and a second end 86 including a resilient tongue member 88 which is deflected as it engages outer plug shield 26, during mating of plug 12 with receptacle assembly 14. As can be seen from FIG. 1, medial body portion 84 includes mounting ears 90 which are inserted in channels 72 in the direction of insertion 74 of plug 12 to effect mounting of clips 78 in receptacle housing 44.

As plug 12 is mated with the receptacle assembly 14, outer plug shield 26 engages tongue members 88 with a wiping action, thereby deflecting tongues 88 toward the bottom of the receptacle housing wall. In the preferred embodiments of FIGS. 1–4, recesses 94 are provided in the bottom housing wall to receive the deflected tongue members 88, thereby allowing the lower surface of external plug shield 26 to engage the bottom housing wall upon completed mating of plug 12 and receptacle assembly 14.

As indicated in FIG. 2, the contact fingers 82 of the other end of clip 78 are coupled to conductive panel surface 70, with cable shield 24 and external plug shield 26 being thereby effectively coupled to conductive panel surface 70. By having a plurality of spaced-apart clip members 78 disposed around the mounting face 48 of housing plug receiving end 46, optimum electrical connection between clips 78 and conductive panel surface 70 is assured, despite warpage of either panel 64 or receptacle housing 44.

Figure 4:
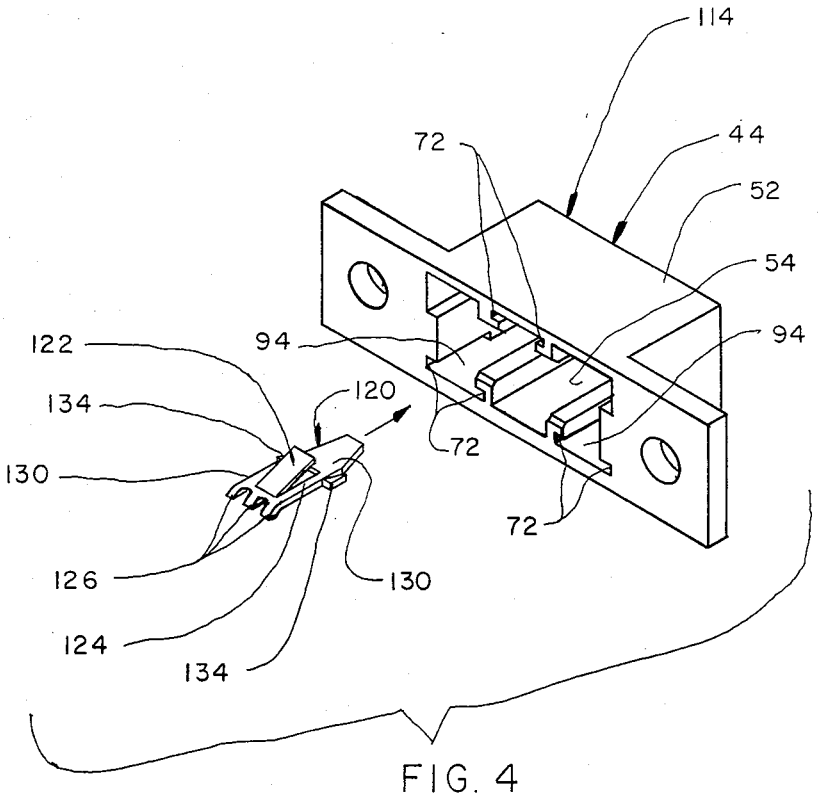
FIG. 4 is alternative embodiment of the receptacle assembly of the present invention.

Referring now to FIG. 4, an alternative embodiment of the present invention is shown comprising the receptacle assembly 114 which is similar to assembly 14 shown above, but with channels 72 extending deeper into housing cavity 54, closer toward second closed end 50. In the alternative clip design 120 incorporated in this embodiment, the resilient tongue member 122 is struck from a terminal body portion 124 located adjacent the spring contact fingers 126. The mounting ears 130 extend along substantially the entire edge of body portion 124, such that the terminal body portion adjacent the free of tongue member 122 is secured within channels 72. Terminal securement barbs 134 are provided on either channel engaging portion 130 to provide retention of clips 120 within receptacle housing 44. Recess 94 allows tongue member 122 to be deflected outside of receptacle cavity 54, thereby allowing engagement between tongue member 122 and plug shield 26.

Terminal 120 of FIG. 4 is substantially identical to clip 78 of FIGS. 1–3, except that a U-shaped frame member is disposed adjacent the edges of tongue member 122, the U-shaped member comprising the remaining portion of the blank from which tongue member 122 is struck. The embodiment of FIG. 4 would be employed, for example, when greater retention force is required for mounting of the clip member within receptacle housing 44.

It can be seen that the present invention provides a completed receptacle assembly having a discontinuous array of conductive clip members mounted in a receptacle housing wall adjacent a plug receiving end thereof, such that the contact fingers at the leading end of the clip members project outwardly beyond the housing mounting face. It will be readily appreciated by those skilled in the art that the present invention allows for a reduction in the number of parts that must be carried in inventory, since a single receptacle housing can be used in both shielded and nonshielded applications. When a housing for use in a shielded system is required, the connector manufacturer, using inexpensive automated techniques, can load a plurality of discrete clip members in the receptacle housing prior to shipment to the end user. The end user benefits since mounting of both non-shielded and shielded receptacle housings is identical, requiring no modification or special consideration.

We claim:

1. A grounded receptacle assembly mountable in an opening of a panel having a grounded conductive surface for receiving and electrically engaging a shielded plug connector, said plug connector including a housing, a plurality of terminals mounted in said housing and a conductive shield externally mounted on said plug housing, said receptacle assembly including a receptacle housing with an open plug receiving end surrounded by a mounting face, a plurality of terminals mounted in said housing adapted to mate with said plug terminals and grounding means attached to said receptacle housing to connect the plug shield with the grounded panel, the improvement comprising:

said receptacle grounding means including a plurality of spaced-apart stamped metallic clips which are not unitary with one another and which are mounted in the receptacle housing, each clip having a mounting portion secured in the housing, a plug engaging end in the housing adapted to contact the plug shield and a spring portion extending out of the plug receiving opening adjacent the mounting face for resilient compression against the panel surface; and said receptacle housing including a plurality of slots formed in the mounting face and extending into the housing to receive the mounting portion of each clip therein.

2. The assembly of claim 1 wherein the receptacle housing slots include pairs of opposed channels located adjacent said plug receiving end of said receptacle housing, and said clip mounting portion includes transversely extending mounting ears which are slidingly received in said channels in a direction of insertion of said plug connector.

3. The assembly of claim 2 wherein said receptacle housing further includes an indent inward of the mounting face for receiving said plug engaging end when electrical connection is made therewith to said plug shield.

4. The assembly of claim 2 wherein said plug engaging end includes resilient tongue means struck from said clip.

5. The assembly of claim 1 wherein said receptacle terminal comprise pin-like members mounted in a second housing end opposing said plug receiving end.

* * * * *